US007940153B2

(12) United States Patent
Watanabe

(10) Patent No.: US 7,940,153 B2
(45) Date of Patent: May 10, 2011

(54) INDUCTANCE ELEMENT

(75) Inventor: Tsutomu Watanabe, Tokyo (JP)

(73) Assignee: Sumida Corporation (JP)

( * ) Notice: Subject to any disclaimer, the term of this patent is extended or adjusted under 35 U.S.C. 154(b) by 0 days.

(21) Appl. No.: 12/126,526

(22) Filed: May 23, 2008

(65) Prior Publication Data

US 2008/0290975 A1 Nov. 27, 2008

(30) Foreign Application Priority Data

May 25, 2007 (JP) ..... 2007-139491

(51) Int. Cl.
*H01F 27/29* (2006.01)
*H01F 27/02* (2006.01)
*H01F 5/00* (2006.01)

(52) U.S. Cl. ..... 336/192; 336/83; 336/200

(58) Field of Classification Search ..... None
See application file for complete search history.

(56) References Cited

U.S. PATENT DOCUMENTS

| | | | | |
|---|---|---|---|---|
| 4,639,696 | A * | 1/1987 | Murata | 333/138 |
| 5,751,203 | A * | 5/1998 | Tsutsumi et al. | 336/65 |
| 6,154,112 | A * | 11/2000 | Aoba et al. | 336/192 |
| 6,292,083 | B1 * | 9/2001 | Tajima et al. | 336/192 |
| 6,653,923 | B2 * | 11/2003 | Li et al. | 336/206 |
| 6,747,538 | B2 * | 6/2004 | Kuwata et al. | 336/83 |
| 6,922,130 | B2 * | 7/2005 | Okamoto | 336/208 |
| 7,042,324 | B2 * | 5/2006 | Watanabe | 336/192 |
| 7,463,130 | B2 * | 12/2008 | Oki | 336/192 |
| 2006/0284716 | A1 * | 12/2006 | Yamaguchi | 336/199 |
| 2007/0018770 | A1 * | 1/2007 | Kamio | 336/221 |
| 2007/0241850 | A1 * | 10/2007 | Watanabe | 336/73 |

FOREIGN PATENT DOCUMENTS

| | | |
|---|---|---|
| JP | 2003-168616 | 11/2001 |
| WO | WO 2005/117038 A1 | 12/2005 |

* cited by examiner

*Primary Examiner* — Anh T Mai
*Assistant Examiner* — Mangtin Lian
(74) *Attorney, Agent, or Firm* — Stephen M. Chin; Von Simson & Chin LLP

(57) ABSTRACT

An inductance element has a first core portion having a winding frame portion; a coil provided on the winding frame portion; a ring-shaped member having an insertion hole to dispose the first core portion therein; and a terminal member having an bonding arm to be fixed to the ring-shaped member via an adhesive member, and a mounting portion.

8 Claims, 11 Drawing Sheets

【Fig.11】
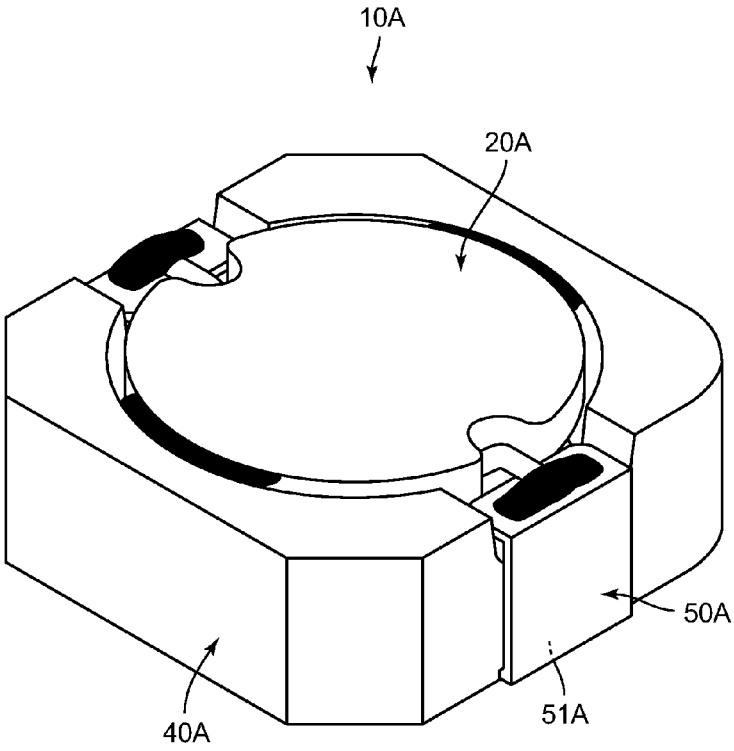
--PRIOR ART--

INDUCTANCE ELEMENT

CROSS-REFERENCE TO RELATED APPLICATIONS

This application relates to and claims priority rights from Japanese Patent Application No. 2007-139491, filed on May 25, 2007, the entire disclosure of which is hereby incorporated by reference herein.

BACKGROUND

1. Technical Field

The present invention relates to an inductance element used in an electronic equipment such as a cellular phone, a digital camera, a mobile device and a laptop personal computer.

2. Related Art

Some inductance elements include a drum-type core and some include a ring-type core. Among these types of inductance elements, there is an inductance element in which a hoop terminal is provided on an outer peripheral surface of a ring-type core. Such an inductance element is disclosed in Japanese Patent Application Laid-Open No. 2003-168616. According to the inductance element of Japanese Patent Application Laid-Open No. 2003-168616 (see paragraph 0036 and FIG. 3), a mounting portion, which is in a lower face side of the hoop terminal, is fixed to the ring core by an adhesive.

SUMMARY

In these days, it is required to further downsize those inductance elements. There has been a problem that an advanced downsizing can cause deterioration of adhesive strength since the adhesion area of the hoop terminal is reduced. In particular, according to the inductance element disclosed in Japanese Patent Application Laid-Open No. 2003-168616, since an advanced downsizing reduces the adhesion area, adhesive strength is reduced and the hoop terminal can be easily come off.

As an another conventional example, there is an inductance element in which a U-shaped hoop terminal is employed, an adhesive is applied to an inner side of the U-shaped hoop terminal and the hoop terminal is adhered to a ring-type core, as shown in FIG. 8 of Japanese Patent Application Laid-Open No. 2003-168616. However, in this case, a large amount of adhesive is required. The adhesive sometimes run off from the adhesion area and the run-off adhesive can be spread to a mounting portion. This can cause a connection failure, for example.

In some cases, a ring-shaped member made of resin, for example, is provided as a substitute for the ring-type core. Here, a hoop terminal is often adhered to the ring-shaped member using an adhesive. However, regarding the ring-shaped member made of resin, adhesive strength of the hoop terminal is lower than that of the ring-type core so that the hoop terminal can come off more easily.

The present invention has been made in view of the above problem and has an object to provide an inductance element in which a hoop terminal hardly comes off even when the inductance element is further downsized.

In order to solve the above problem, the present invention includes a first core portion having a winding frame portion; a coil provided on the winding frame portion; a ring-shaped member having an insertion hole to dispose the first core portion therein; and a terminal member having an bonding arm to be fixed to the ring-shaped member via an adhesive member, and a mounting portion.

With this structure, the terminal member is fixed to the ring-shaped member via the bonding arm using the adhesive member such as adhesive.

When this method of fixing the terminal member is employed, the fixation strength can easily be improved since a terminal member has an bonding arm having a main function for fixing the terminal member to the ring-shaped member. The terminal member thus hardly comes off the ring-shaped member. Further, since the terminal member hardly comes off, downsizing of the inductance element can easily be achieved. Further, since the bonding arm is provided and adhesive strength is maintained, the adhesive member is not required to the parts except the bonding arm of the terminal member. This prevents the adhesive member from running off to mounting area of the mounting portion and the like, and a connection failure can be prevented.

In another aspect of the present invention, at least one end of the winding frame portion of the first core portion has a flange.

This structure prevents the coil around the winding frame portion from shifting in an axial direction of the first core portion. Thus, the coil can surely be fixed to the winding frame portion.

In another aspect of the present invention, the flange has a cutout portion.

With this structure, a terminal of the coil around the winding frame portion can be led out via the first core portion placed in the insertion hole of the ring-shaped member. Thus, the terminal of the coil can easily and electrically be connected to the terminal member.

In another aspect of the present invention, the ring-shaped member is made of resin.

With this structure, since the processability and formability of the ring-shaped member are improved, a ring-shaped member corresponding to the shape of the bonding arm of the terminal member can easily be employed. This makes it easier to surely fix the terminal member to the ring-shaped member.

In another aspect of the present invention, the ring-shaped member has a groove to dispose the bonding arm therein.

With this structure, the bonding arm placed in the groove of the ring-shaped member is supportedly fixed to inner walls of the groove. Thus, the terminal member can be more strongly fixed to the ring-shaped member.

In another aspect of the present invention, the ring-shaped member and the bonding arm are fixed via the adhesive member after the bonding arm is placed in the groove.

With this structure, the bonding arm is placed in the groove and the adhesive member is applied to the groove. Then the applied adhesive member becomes hardened. The hardened adhesive fixes the bonding arm to the ring-shaped member. When this method of fixing the terminal member is employed, the bonding arm is made to be buried in the hardened part of the adhesive member. Thus the fixation strength at the bonding arms become very strong and the terminal member hardly come off the ring-shaped member in more cases.

In another aspect of the present invention, the groove is a concave groove provided between an outer wall face and the insertion hole of the ring-shaped member; and the adhesive member is hardened as covering not only the groove but also a portion between the first core portion and the ring-shaped member so that the first core portion and the ring-shaped member are fixed to each other.

With this structure, since the adhesive member is applied to cover the portion between the first core portion and the ring-shaped member, the first core portion and ring-shaped member are fixed by the hardened adhesive member. Here, the terminal member and the ring-shaped member are adhered and the ring-shaped member and the first core portion are adhered only in a single process for applying the adhesive member to the groove. Thus, the number of processes in the inductance element manufacturing can be reduced.

In another aspect of the present invention, the terminal member has a side portion contacting to an outer wall face of the ring-shaped member and a normal line direction of the terminal member is different from those of the mounting portion and the bonding arm, and a terminal connecting portion provided on a surface opposite to a surface facing to a mounting substrate of the first core portion, and electrically connected to a terminal of the coil.

With this structure, the side portion contacts the outer wall face of the ring-shaped member, the mounting portion is placed in a first side (a surface facing to the mounting substrate of the first core portion) and the terminal connecting portion is placed in a second side (a surface opposite to a surface facing to a mounting substrate of the first core portion). The terminal member is positioned accordingly. Since the bonding arm is placed in the groove and fixed in the groove by hardened adhesive member after the terminal member is positioned, a sufficient fixation strength can be obtained even when only the bonding arm is fixed.

BRIEF DESCRIPTION OF THE DRAWINGS

FIG. 11 is a perspective view showing a configuration of a conventional inductance element.

DETAILED DESCRIPTION

An inductance element 10 according to an embodiment of the present invention will be described with reference to FIGS. 1 to 11.

Figure 1:
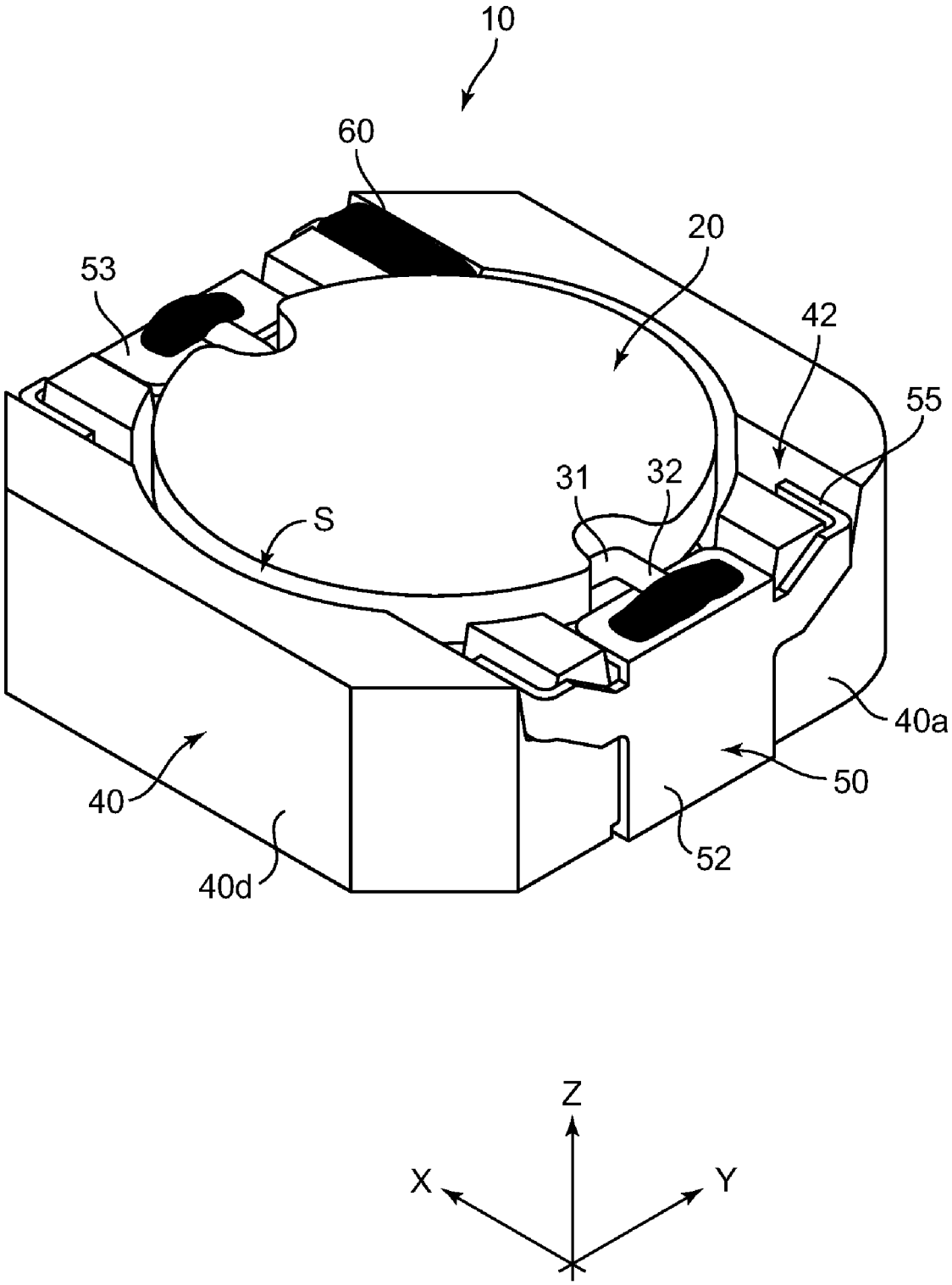
FIG. 1 is a perspective view showing a configuration of an inductance element according to an embodiment of the present invention.
Figure 2:
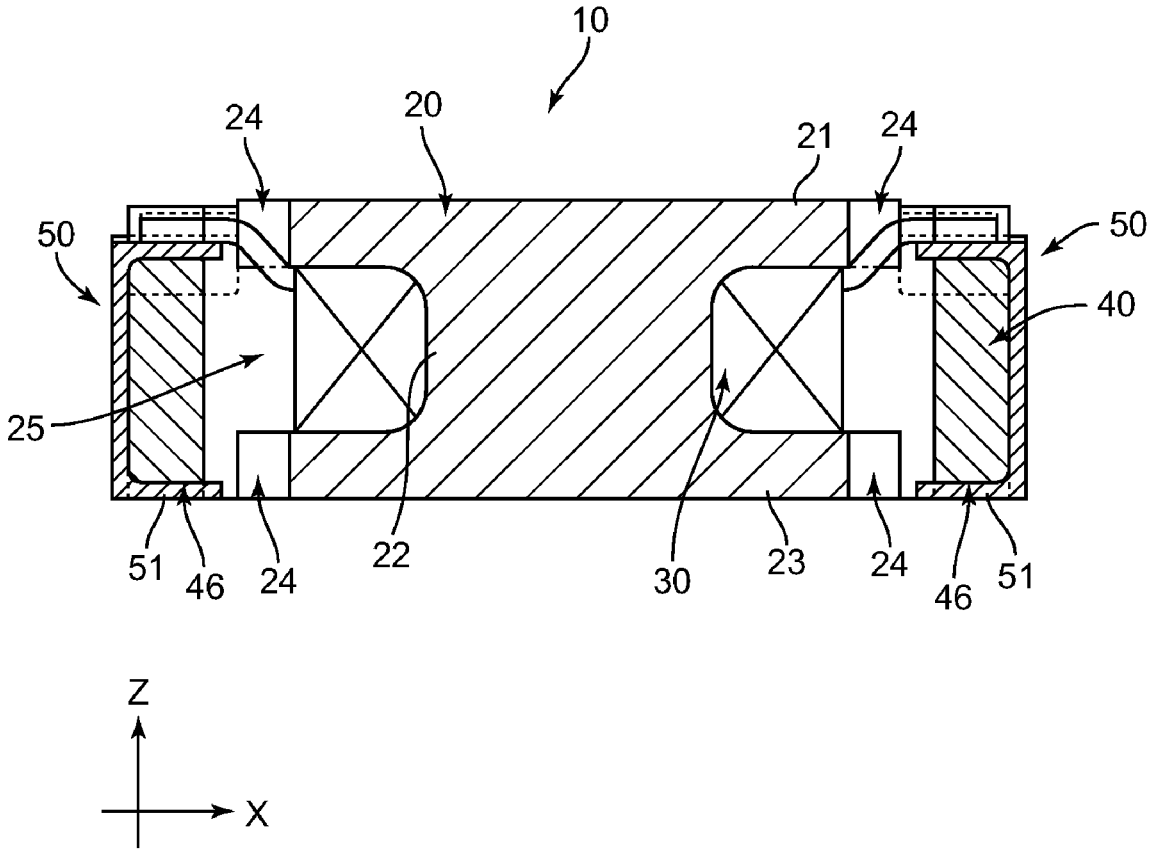
FIG. 2 is a sectional view showing the configuration of the inductance element of FIG. 1.

As shown in FIGS. 1 and 2, the inductance element 10 of the present embodiment includes a drum core 20, a coil 30, a ring-shaped member 40 and a hoop terminal 50. The drum core 20 has an upper flange portion 21, a column portion 22, a lower flange portion 23.

Figure 3:
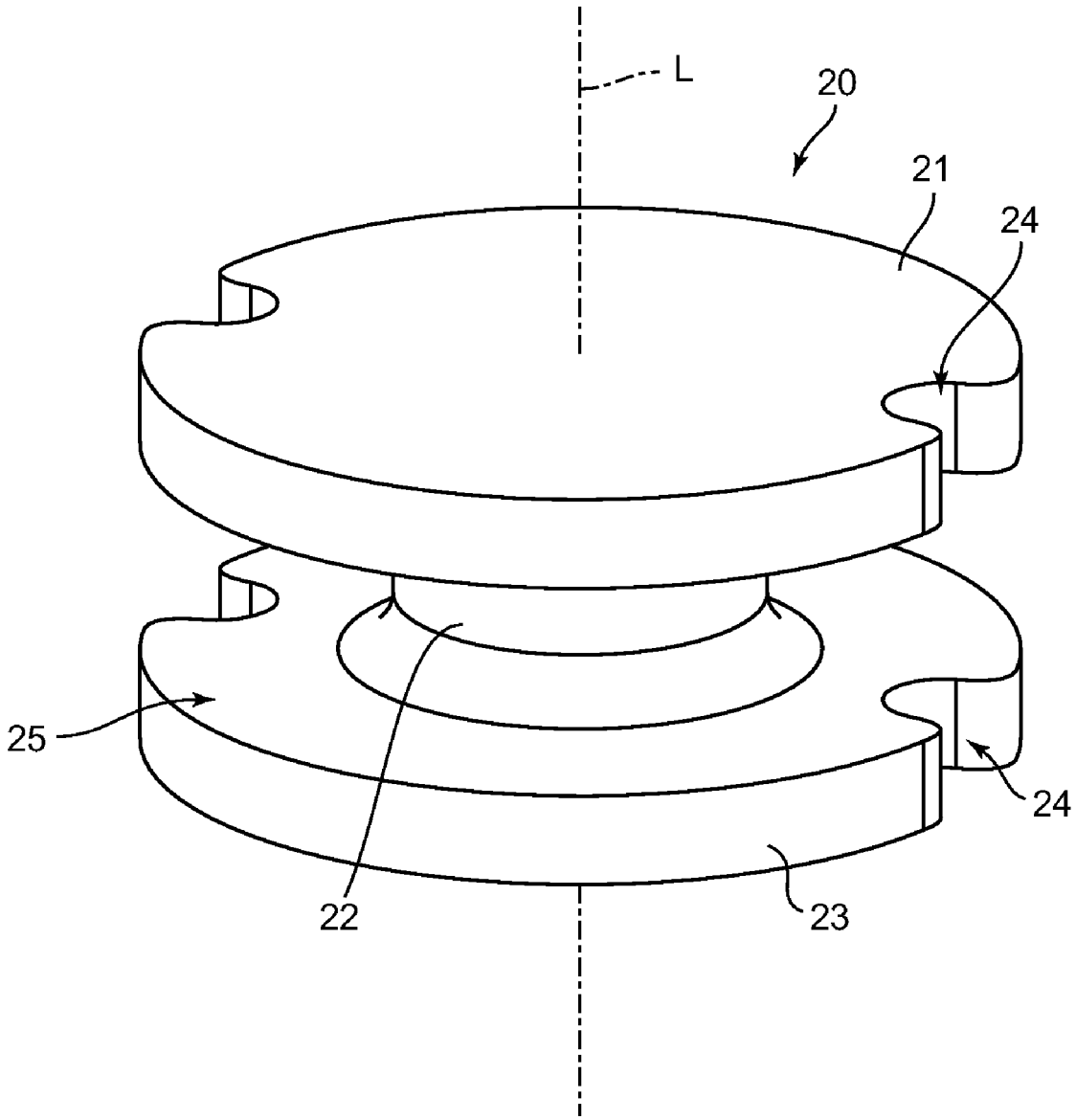
FIG. 3 is a perspective view showing a configuration of a drum core in the inductance element of FIG. 1.

The drum core 20 is a disk-drum body having a center axis L shown in FIG. 3 and the upper flange portion 21, column portion 22 and lower flange portion 23 are formed in circular shapes in a plane view. The drum core 20 corresponds to a first core portion. Further, the drum core 20 is made of a magnetic material such as a nickel ferrite core, for example. Here, the magnetic material is not limited to the nickel ferrite core and a manganese ferrite core is also acceptable. Similarly, the material of the drum core 20 is not limited to the ferrite core, and the other magnetic materials such as Permalloy can also be employed.

The lower flange portion 23 of the drum core 20 is formed in a substantially same size as the upper flange portion 21. The upper flange portion 21 and the lower flange portion 23 respectively have cutout portions 24. The cutout portion 24 is a portion cut out in a curved concave shape and, according to the present embodiment, the upper flange portion 21 and the lower flange portion 23 respectively have two cutout portions 24 spaced apart at 180-degree intervals. At the cutout portions 24, terminals 32 which is lead out portion of the coil 30 can be placed. The terminals 32 are electrically connected to terminal connecting portions 53 of the later described hoop terminal 50 by soldering and the like. According to the embodiment shown in FIG. 3, the upper flange portion 21 and lower flange portion 23 respectively have the cutout portions 24; however, the cutout portions 24 can be omitted.

A winding frame portion 25 is provided at a portion outside the column portion 22 and between the upper flange portion 21 and lower flange portion 23. As shown in FIG. 2, the coil 30 is disposed at the winding frame portion 25. The coil 30 is formed by winding wire. The wire 31 is a wire which outer peripheral portion is covered by an insulating coat layer, such as an enameled wire. Further, the wire 31 is a conducting wire having a substantially circular cross section. However, the cross section of the wire 31 is not limited to the substantially circular shape and the wire 31 can be a ribbon wire (rectangular wire) having a narrow rectangular cross section.

Figure 4:
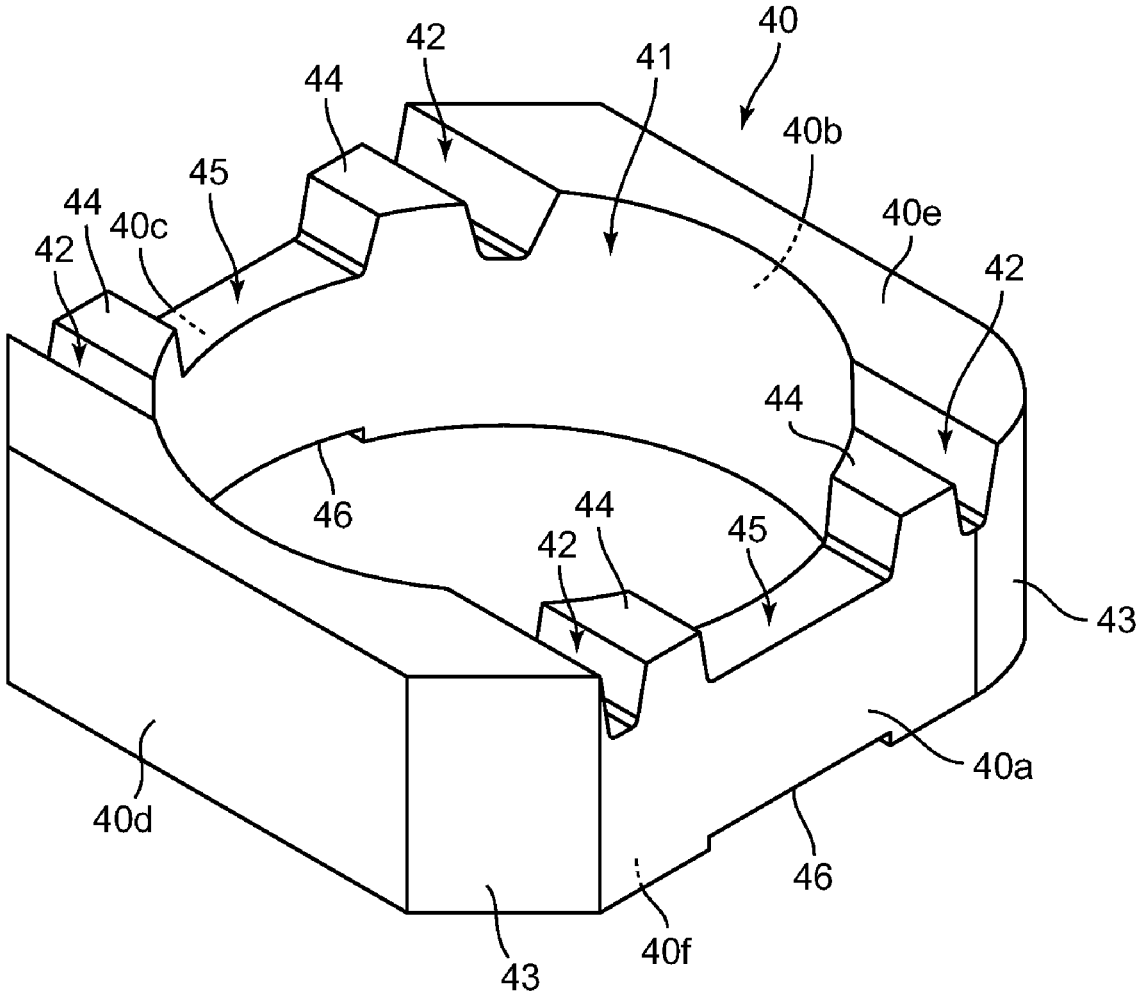
FIG. 4 is a perspective view showing a configuration of a ring-shaped member in the inductance element of FIG. 1.

The ring-shaped member 40 shown in FIG. 4 is made of resin and formed in a ring shape which plan view is a substantially rectangular. According to the present embodiment, the substantially rectangular ring-shaped member 40 has four corners cut out. The ring-shaped member 40 is an annular shaped member having a insertion hole 41 in its center. The ring-shaped member 40 is placed facing to the drum core 20 with a space S therebetween. The inside diameter of the insertion hole 41 is made larger to form space S, compared to the outside diameters of the upper flange portion 21 and lower flange portion 23.

Grooves 42 are provided in an upper face 40*e* side of the ring-shaped member 40 (that is, a second side, a surface opposite to a surface facing to a mounting substrate of the first core portion). The grooves 42 are portions to place later described bonding arms 55 therein. Seen from the side of the groove 42, the groove 42 is formed in a substantially V shape. Further, as described above, since the bonding arm 55 is placed in the groove 42, the depth of the groove 42 is made larger than the length in height of the bonding arms 55. The grooves 42 are provided to be exposed to opposite outer wall faces 40*a*, 40*c* among outer wall faces 40*a*, 40*b*, 40*c*, 40*d* of the ring-shaped member 40. Further, in the outer wall faces 40*a*, 40*c*, the grooves 42 are provided to be exposed to a portion contacting to cutoff portions 43. According to the present embodiment, the grooves 42 are provided along a normal line direction of the outer wall faces 40*a*, 40*c*.

Between the pair of grooves 42 in the respective outer wall faces 40*a*, 40*c*, an upper face concave portion 45 is provided as being sandwiched between projected portions 44 which define the groove 42. The upper face concave portion 45 is a place where the terminal connecting portion 53 of the hoop terminal 50 is placed. According to the present embodiment, the upper face concave portion 45 is provided substantially parallel to the upper face 40*e* of the ring-shaped member 40 and has a width slightly larger than the terminal connecting portion 53 as corresponding to the width of the terminal connecting portion 53.

According to the embodiment shown in FIG. 4, the projected portion 44 is provided continuously from the insertion hole 41 to the outer wall face 40*a*, 40*c*; however, the projected portion 44 can be provided partially between the insertion hole 41 to the outer wall face 40*a*, 40*c*.

A terminal side concave portion 46 is provided on the lower face 40*f* of the ring-shaped member 40 (that is, a first side, a surface facing to the mounting substrate of the first core portion). The terminal side concave portion 46 is a place where a mounting portion 51 of the hoop terminal 50 is placed. Thus the terminal side concave portion 46 is formed concave upwardly in a predetermined size, compared to the other portions of the lower face 40*f* of the ring-shaped member 40. Further, the terminal side concave portion 46 is provided continuously across the ring-shaped member 40 from the outer wall face 40*a*, 40*c* to the insertion hole 41. The concave size (cut off size) of the terminal side concave portion 46 is determined so that, when the mounting portion 51 is placed in the terminal side concave portion 46 as described below, the mounting portion 51 slightly projects downwardly from the lower face 40*f* of the ring-shaped member 40 and the lower face of the drum core 20.

Figure 5:
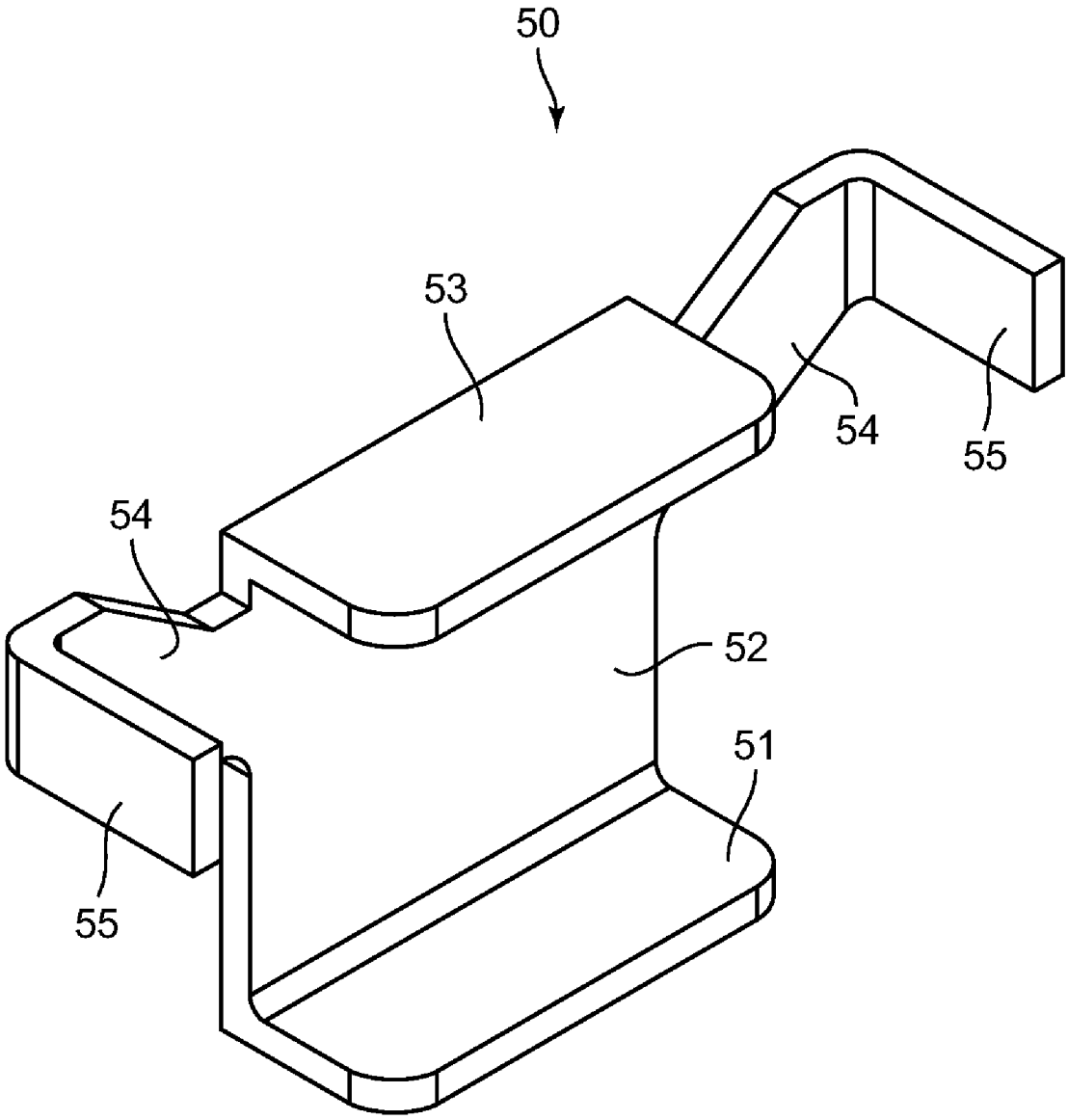
FIG. 5 is a perspective view showing a configuration of a hoop terminal in the inductance element of FIG. 1.

As shown in FIG. 5, the hoop terminal 50 is formed, for example, by punching and bending a metal plate, and accordingly the normal line directions are bent to extend along the three axial directions. The hoop terminal 50 corresponds to a terminal member and includes the mounting portion 51, a side portion 52, the terminal connecting portion 53, a side extension portion 54 and the bonding arms 55. Among these components, the mounting portion 51 is a portion to be placed in the terminal side concave portion 46. Therefore, the mounting portion 51 has a width (the length of X direction in FIG. 2) not to interfere with the lower flange portion 23 when the side portion 52 contacts the outer wall face 40*a*, 40*c*. Here, the length of the extension of the mounting portion 51 in the Y direction shown in FIG. 1 is slightly smaller than the width of the terminal side concave portion 46 in the Y direction.

The terminal connecting portion 53 is placed at an end (the upper end in FIG. 1) opposite from the mounting portion 51 and the side portion 52 is placed therebetween. The terminal connecting portion 53 is a portion inserted into the upper face concave portion 45 and made in a size corresponding to the upper face concave portion 45. According to the present embodiment, the shape and size of the terminal connecting portion 53 are made substantially the same as those of the mounting portion 51. However, the terminal connecting portion 53 can be provided in different shape and size from the mounting portion 51.

According to the present embodiment, the side portion 52 is a portion constituting the largest area in the hoop terminal 50. Further, the side extension portion 54 is formed as a continuous planer face of the side portion 52, and extends in a direction away from a portion of the side portion 52 slightly lower than the terminal connecting portion 53 and toward the terminal connecting portion 53 side (upwardly). The side portion 52 and the side extension portion 54 are both made to contact the outer wall face 40*a*, 40*c*.

The bonding arm 55 has an end, which is formed continuous to the side extension portion 54. The bending direction of the bonding arms 55 is different from those of the mounting portion 51 and terminal connecting portion 53, and the bonding arm 55 is bended so that the normal line of the bonding arms 55 lays along the Y direction (see FIG. 1). Further, the bonding arm 55 is a portion to be inserted in the groove 42. According to the present embodiment, the width of the bonding arm 55 (size in height (Z direction)) is made smaller than that of the groove 42 so that, when an adhesive is applied, the bonding arm 55 is buried in the adhesive. Further, the bonding arm 55 has a length corresponding to the length of the groove 42 and, more concretely, the bonding arm 55 is provided not to project from the groove 42 when adhered in the groove 42.

A method for manufacturing the inductance element 10 having the above described configuration will be described. Firstly, the wire 31 is coiled around the winding frame portion 25 for predetermined numbers of turns. The coil 30 is then formed and the terminal 32 of the coil 30 is led out in a predetermined length. Further, separately from the coil 30 formation, the hoop terminal 50 is formed in advance by punching and bending (or pressing and the like) a metal plate. In the hoop terminal 50 formed here, the mounting portion 51, terminal connecting portion 53, side portion 52 and bonding arms 55 are bended so that their normal line directions are different from each other (extend in three axial directions).

Next, the drum core 20, in which the coil 30 is disposed, is placed in the insertion hole 41 of the ring-shaped member 40. Here, the cutout portion 24 and the upper face concave portion 45 are placed facing to each other. Then, the hoop terminal 50 is attached to the ring-shaped member 40. When attaching the hoop terminal 50, the terminal connecting portion 53 is inserted into the upper face concave portion 45 and the bonding arms 55 are inserted in the grooves 42. Prior to disposing the drum core 20 in the insertion hole 41, the hoop terminal 50 can be attached to the ring-shaped member 40.

Then, the terminal 32 is fixed and electrically connected to the terminal connecting portion 53 by, for example, welding or soldering. Further, after the bonding arm 55 is placed in the groove 42, an adhesive is supplied. The adhesive is supplied to the groove 42 to bury the bonding arm 55 with the adhesive. In addition, the adhesive is applied to cover the space S between the drum core 20 and ring-shaped member 40. In this case, one adhesive supply operation for one groove 42 is executed to supply the adhesive to cover both of the groove 42 and the space S. The adhesive supply is preferably executed prior to the welding or soldering of the terminal 32 to the terminal connecting portion 53. However, the welding or soldering of the terminal 32 to the terminal connecting portion 53 can be executed prior to the adhesive supply to the groove 42.

When the supplied adhesive is hardened, an adhesive hardened portion 60 (corresponding to a hardened part; see FIG. 1) is formed. Here, since the bonding arm 55 is buried in the adhesive hardened portion 60, the hoop terminal 50 is strongly fixed. Thus, according to the present embodiment, the adhesive is not applied to other parts of the hoop terminal 50 except for the bonding arms 55. However, the adhesive can be applied to the other parts other than the bonding arms 55.

The inductance element 10 is formed as described above.

In the inductance element 10 having such a structure, the hoop terminal 50 is fixedly attached to the ring-shaped member 40 via the bonding arms 55. In this case, since the bonding arm 55 is buried in the adhesive hardened portion 60, the hoop terminal 50 is strongly fixed by the bonding arm 55. Thus, the hoop terminal 50 hardly comes off the ring-shaped member 40. Further, since the hoop terminal 50 hardly comes off, downsizing of the inductance element 10 can be achieved more easily.

According to the present embodiment, both sides of the bonding arm 55 are adhered to the adhesive hardened portion 60. This increases the contact area between the bonding arms 55 and the adhesive hardened portion 60 although the size of the bonding arm 55 is limited. Further, the area (space) required to adhere the hoop terminal 50 can be reduced compared with the conventional inductance elements.

FIG. 11 shows a conventional inductance element 10A as a comparative example. In the inductance element 10A shown in FIG. 11, a hoop terminal 50A is formed in a substantially U-shape as seen in a side view. Further, the adhesive is applied to the inner side of the U-shaped hoop terminal 50A. In this case, the adhesive applied to the inner side of the hoop terminal 50A sometimes runs off. For example, when the run-off adhesive flows to the side of the mounting portion 51A and contact a mounting substrate, a connection failure can occur when the inductance element 10A is mounted.

However, according to the inductance element 10 of the present embodiment, since the bonding arms 55 is provided, a sufficient adhesive strength can be maintained and it is not required to apply the adhesive to other parts of the hoop terminal 50 other than the bonding arms 55. Here, the adhesive is not applied to the mounting portion 51 and the like and this can prevent a running-off of the adhesive as described above and a connection failure can be prevented.

In the conventional inductance element 10A, the adhesive is supplied respectively for adhesions between the hoop terminal 50A and the ring-shaped member 40A and between a drum core 20A and a ring-shaped member 40A (see FIG. 11). However, according to the inductance element 10 of the present embodiment, the adhesive is supplied also to cover the space S between the drum core 20 and the ring-shaped member 40. Here, one adhesive supply operation for one groove 42 is executed to supply the adhesive to cover both of the groove 42 and the space S. Thus, the work of adhesive supply can be reduced and the manufacturing efficiency of the inductance element 10 can be improved.

Further, in the hoop terminal 50 of the present embodiment, since the side portion 52 contacts with the outer wall face 40*a*, 40*c* of the ring-shaped member 40 and the mounting portion 51 is placed closely contacting with the terminal side concave portion 46, the hoop terminal 50 is positioned. In the positioned condition, the bonding arms 55 is placed in the groove 42 and fixed by hardening of the adhesive. Here, although only the bonding arm 55 is fixed, a sufficient fixation strength can be maintained.

According to the present embodiment, the adhesive is supplied to the groove 42 apart from the upper face concave portion 45 (terminal connecting portion 53). This can prevent that the adhesive is attached to the terminal connecting portion 53. With this structure, since the adhesive is prevented from being attached to the terminal connecting portion 53, when the terminal 32 is welded or soldered to the terminal connecting portion 53 after supplying the adhesive to the groove 42, a connection failure generated between the terminal 32 and the terminal connecting portion 53 can be prevented.

Although the inductance element 10 according to an embodiment of the present invention has been described, various modifications can be applied to the present invention. Such modifications will be described.

In the above embodiment, the bonding arm 55 is in a plate-like shape and does not have any concave or convex portions. However, a concave portion, a convex portion or a hole can be provided at any part of the bonding arm 55. For example, a part of a side edge of the bonding arm 55 can be cut off to form a concave portion or a metal plate can be punched to form a convex portion projecting from a part of the side edge. Further, the bonding arms 55 can have a hole. When such a concave portion, a convex portion or a hole is provided and the adhesive is applied to form the adhesive hardened portion 60, the concave portion, convex portion or hole is made to be engaged with the adhesive hardened portion 60. With this structure, the hoop terminal 50 hardly comes off the ring-shaped member 40. Further, a part of the bonding arm 55 can be pressed and deformed to form concave or convex portions as seen in a side view.

In the above embodiment, the ring-shaped member 40 is made of resin. However, the ring-shaped member 40 is not limited to what is made of resin and can be made of a magnetic material similarly to the drum core 20.

In the above embodiment, the single hoop terminal 50 has two bonding arms 55. However, the number of the bonding arms 55 provided to the hoop terminal 50 is not limited to two and can be one, three or more.

FIGS. 6 to 9 show other embodiments of the terminal member. In FIGS. 6 to 9, the same reference numerals are used to designate members having the same function and configuration described in the hoop terminal 50 shown in FIG. 5.

Figure 6:
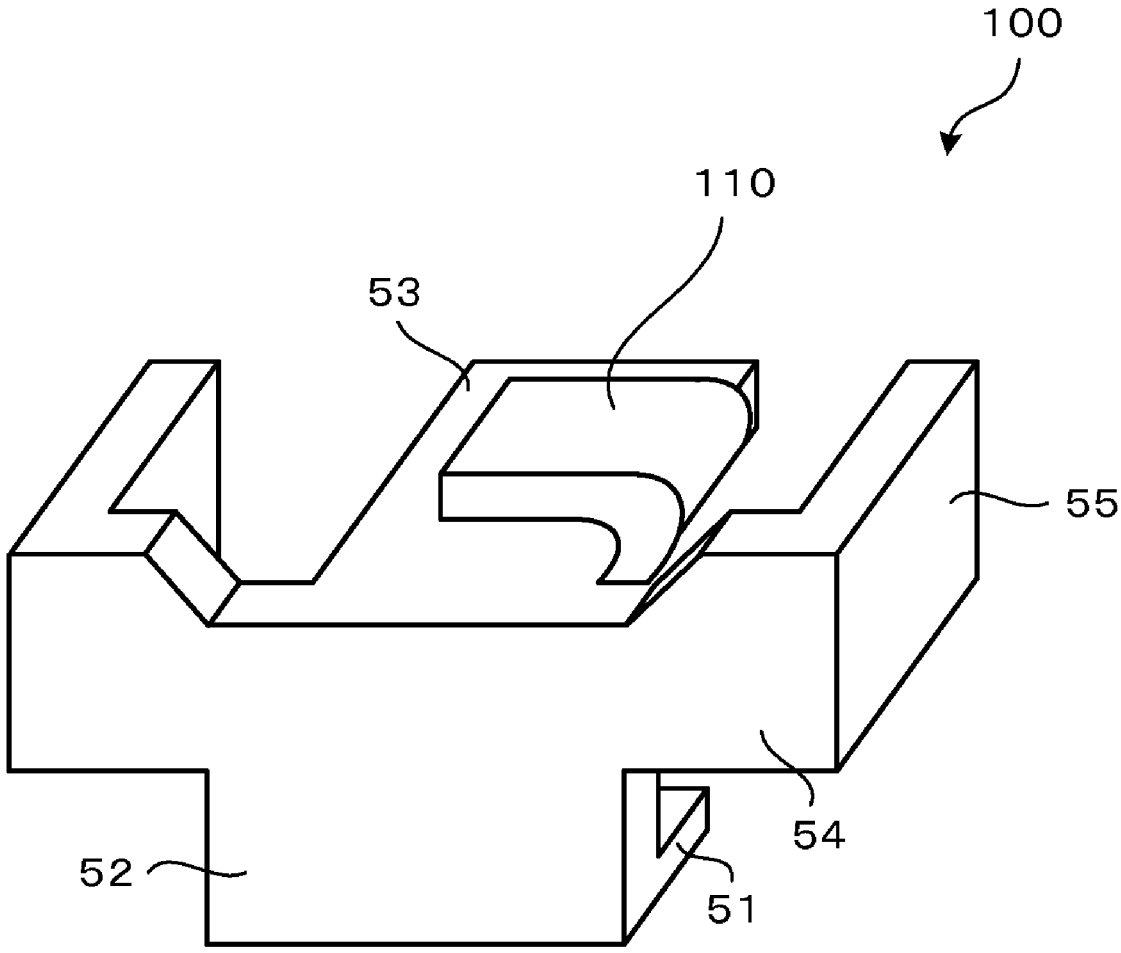
FIG. 6 is a perspective view showing another embodiment of the hoop terminal used in the inductance element of the present invention.

The hoop terminal 100 shown in FIG. 6 is a terminal having the same configuration as the hoop terminal 50 shown in FIG. 5 except for a holding part 110 attached to the terminal connecting portion 53. According to the embodiment shown in FIG. 6, the plate-like holding part 110 is provided to face the second side of the terminal connecting portion 53 and has one end bended and fixed to a side surface of the terminal connecting portion 53. With this structure, the terminal 32 of the coil can be held between the holding part 110 and the terminal connecting portion 53. Thus, since the terminal 32 is fixed to a adhesive position of the terminal connecting portion 53, the terminal 32 can easily be welded or soldered to the terminal connecting portion 53.

The plate-like holding part 110 can be provided to be substantially parallel to the terminal connecting portion 53 as shown in FIG. 6 or can be provided to form an acute angle with respect to the terminal connecting portion 53. Further, the shape of the holding part 110 is not limited to the plate-like shape as shown FIG. 6 and can be formed in any shape that can hold the terminal 32 between the holding part 110 and the terminal connecting portion 53. For example, the holding part 110 can be formed in a curved shape which is convex with respect to the second side of the terminal connecting portion 53.

Figure 7:
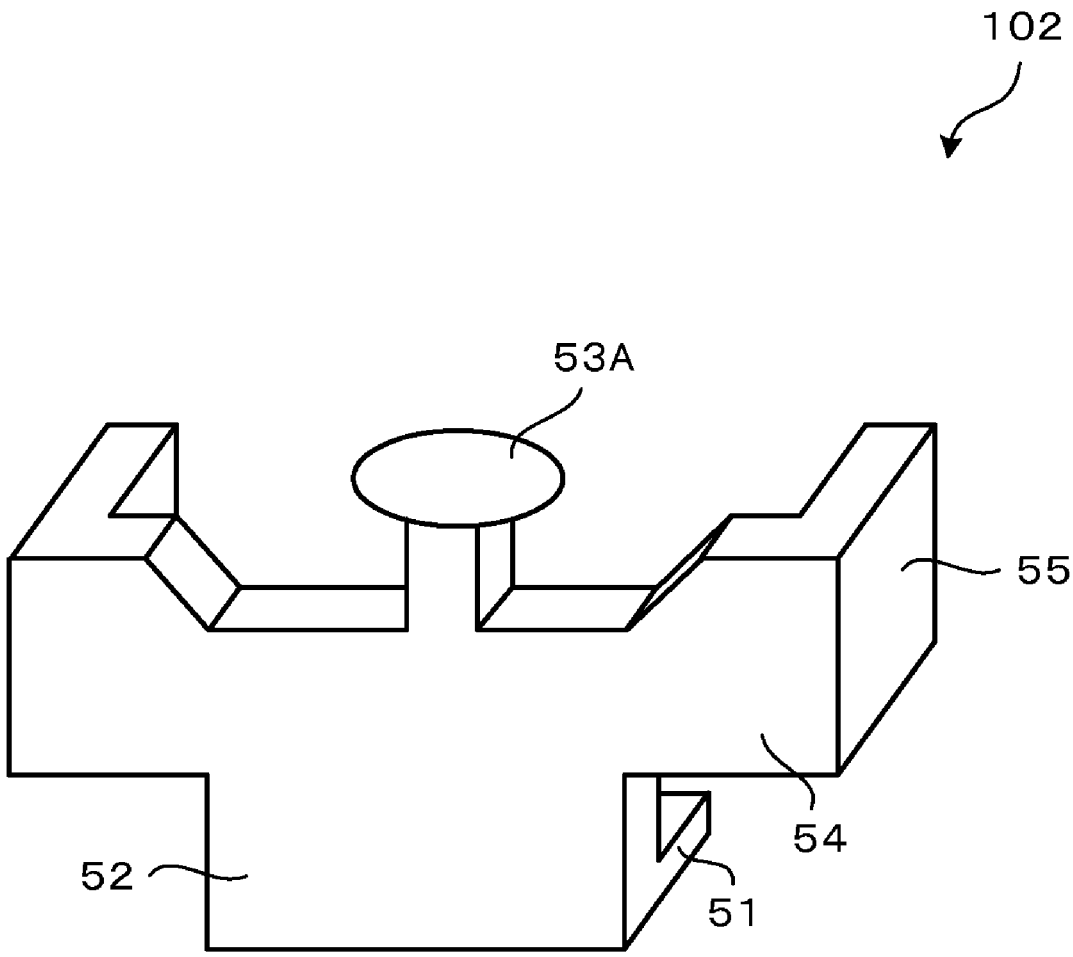
FIG. 7 is a perspective view showing another embodiment of the hoop terminal used in the inductance element of the present invention.

A hoop terminal 102 shown in FIG. 7 is a terminal having the same configuration as the hoop terminal 50 shown in FIG. 5 except for that the terminal connecting portion 53A is not in a plate-like shape as shown in FIG. 5 but is composed of a bar-shaped support part having a function (first function) for coiling the coil and a slide resistance part provided at an end of the support part and having a function (second function) for preventing the coil around the support part from sliding. The terminal connecting portion 53A having such a configuration, the terminal 32 of the coil can be surely held as being coiled around the support part of the terminal connecting portion 53A. Thus, in particular, when the coil has a circular cross section, the coil can be easily held as being coiled around the terminal connecting portion 53A.

According to the example shown in FIG. 7, the terminal connecting portion 53A is formed in a rivet-like shape composed of a square-pole shaped support part and a disk-shaped slide resistance part; however, the support part and the slide resistance part can be formed in any shape if the above functions are maintained. For example, the terminal connecting portion 53A can be formed in a T-shape or an L-shape.

[0058]

Figure 8:
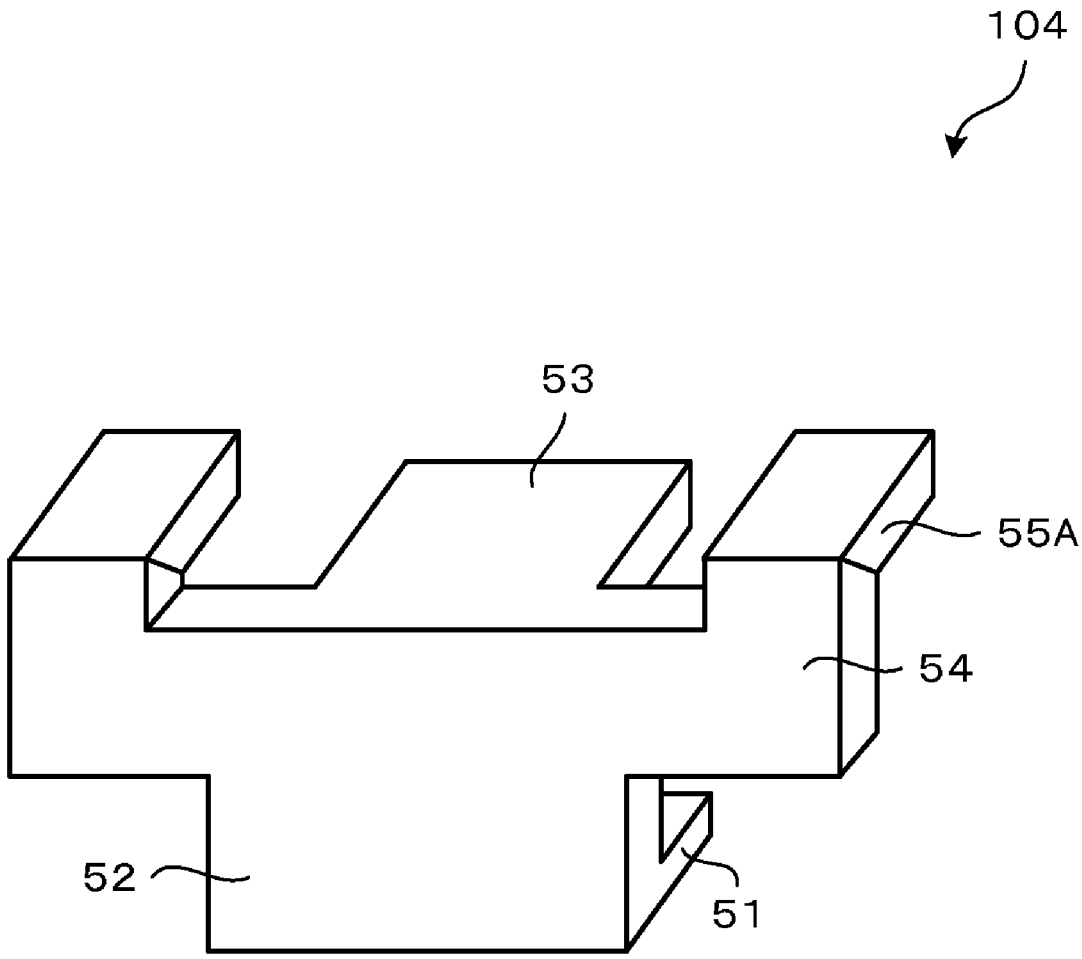
FIG. 8 is a perspective view showing another embodiment of the hoop terminal used in the inductance element of the present invention.

A hoop terminal 104 shown in FIG. 8 is a terminal having the same configuration as the hoop terminal 50 shown in FIG. 5 except for the bonding arms 55A provided so that its normal line direction is substantially parallel to the normal line direction of the terminal connecting portion 53. With this structure, the shape of the ring-shaped member to be combined with the hoop terminal 104 shown in FIG. 8 can be simplified.

In addition, according to the embodiment shown in FIG. 5, when the bonding arm 55 is bent due to a deformation before being attached to the ring-shaped member 40 having groove 42, it can be a trouble to place the bonding arm 55 in the groove 42 smoothly. However, according to the embodiment shown in FIG. 8, when the hoop terminal 104 is attached to the ring-shaped member, deformations of the bonding arms 55A can be easily corrected before attaching to the ring-shaped member.

Figure 9:
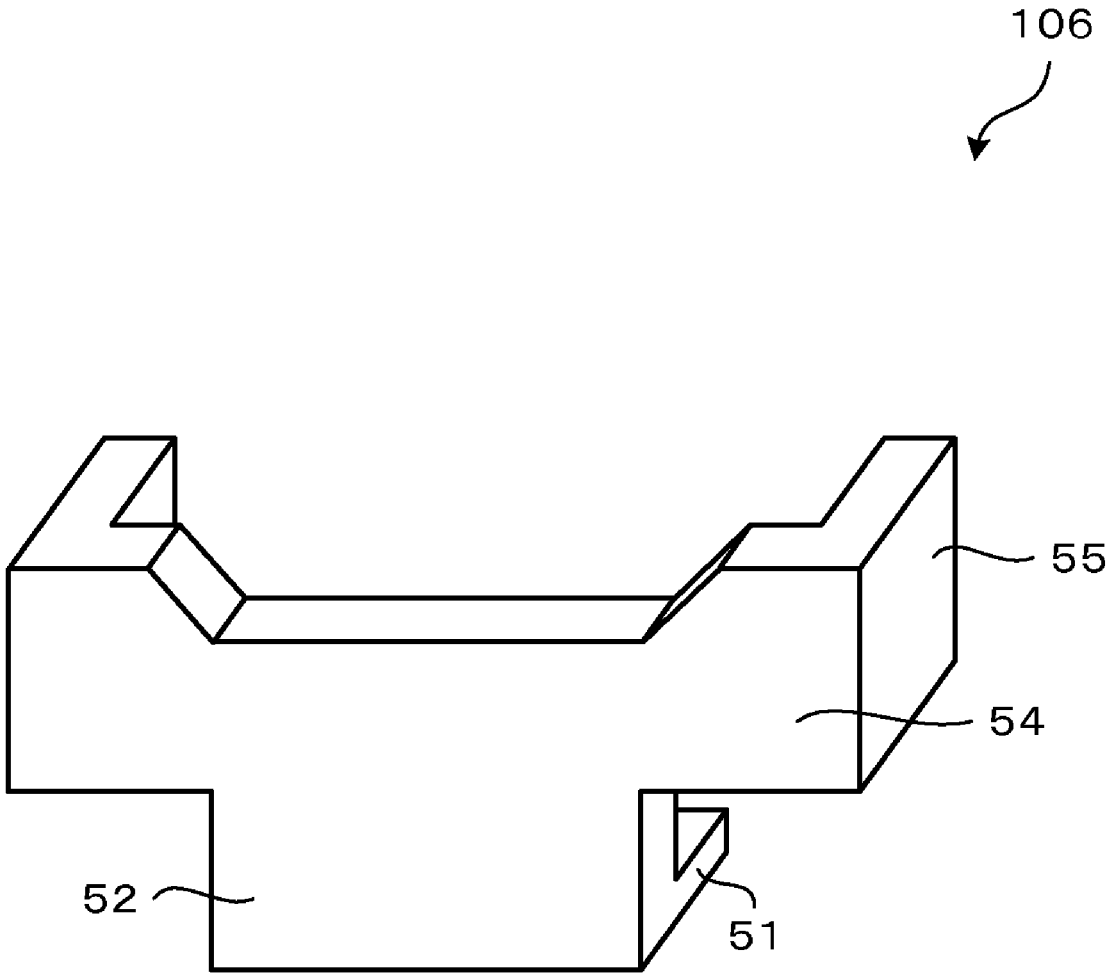
FIG. 9 is a perspective view showing another embodiment of the hoop terminal used in the inductance element of the present invention.

A hoop terminal 106 shown in FIG. 9 has the same configuration as the hoop terminal 50 except for that the plate-like terminal connecting portion 53 is not provided. According to the embodiment shown in FIG. 9, the terminal 32 of the coil can be connected to the side portion 52. Further, since the hoop terminal 106 of FIG. 9 does not include the plate-like terminal connecting portion 53, the second side structure of the ring-shaped member to be combined with the hoop terminal 106 can be simplified as shown in FIG. 10.

Figure 10:
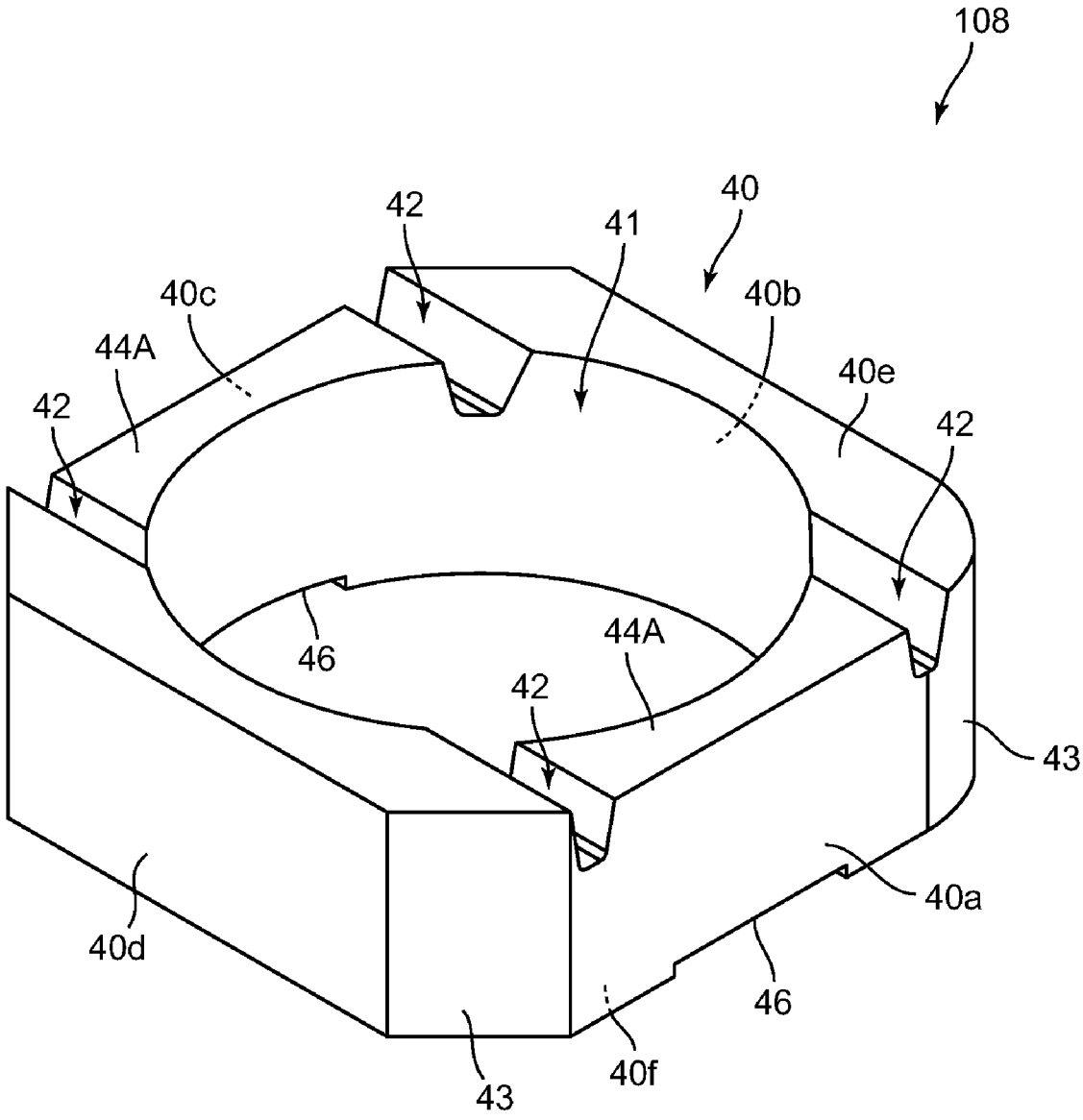
FIG. 10 is a perspective view showing another embodiment of the ring-shaped member used in the inductance element of the present invention.

Here, FIG. 10 shows another embodiment of the ring-shaped member. In FIG. 10, the same reference numerals are used to designate members having the same function and configuration as the ring-shaped member 40 shown in FIG. 4. A ring-shaped member 108 shown in FIG. 10 is a ring-shaped member having the same configuration as the ring-shaped member 40 shown in FIG. 4 except for a projected portion 44A. The projected portion 44A has a structure in which the two projected portions 44 facing to each other as sandwiching the upper face concave portion 45 shown in FIG. 4 are integrally formed.

Here, when an inductance element is created by combining the ring-shaped member 108 shown in FIG. 10 and the hoop terminal 106 shown in FIG. 9, it is preferable to employ the drum core 20 having the cutout portion 24 as shown in FIG. 3 as the first core portion. With such a structure, the terminal 32 of the coil can be led via the cutout portion 24 of the drum core 20 to the outside of the ring-shaped member 108, and the coil terminal 32 can be connected to the side portion 52 of the hoop terminal 106.

Further, the embodiment shown in FIG. 10 provides simplified structure since only the groove 42 are provided on the second side of the ring-shaped member, compared with the embodiment shown in FIG. 4. Thus, when the inductance element is made downsized, the thickness of the ring-shaped member is made thinner and this can prevent the drum core 20 from cracking.

The inductance element of the present invention is applicable to electric equipments.

As described above, the present invention is effective to prevent the hoop terminal from coming off even when the inductance element is made further downsized.

What is claimed is:

1. An inductance element comprising:

a first core portion having a winding frame portion;

a coil provided on the winding frame portion;

a ring-shaped member having an insertion hole to dispose the first core portion therein; and a terminal member having a side portion, a bonding arm which is fixed to the ring-shaped member via an adhesive on top and is formed to bend vertically from said side portion, a mounting portion which is bent vertically from said side portion and terminal connecting part which is bent vertically from said side portion and is electrically connected to terminals of lead out portion of coil and wherein said bonding arm is buried in said adhesive member.

2. The inductance element according to claim 1, wherein at least one end of the winding frame portion of the first core portion has a flange.

3. The inductance element according to claim 2, wherein the flange has a cutout portion.

4. The inductance element according to claim 1, wherein the ring-shaped member is made of resin.

5. The inductance element according to claim 1, wherein the ring-shaped member has a groove to dispose the bonding arm therein.

6. The inductance element according to claim 5, wherein the ring-shaped member and the bonding arm are fixed via the adhesive member after the bonding arm is placed in the groove.

7. The inductance element according to claim 6, wherein the groove is a concave groove provided between an outer wall face and the insertion hole of the ring-shaped member; and the adhesive member is hardened as covering not only the groove but also a portion between the first core portion and the ring-shaped member so that the first core portion and the ring-shaped member are fixed to each other.

8. The inductance element according to claim 1, wherein the terminal member comprising:

a side portion contacting to an outer wall face of the ring-shaped member, whose normal line direction is different from those of the mounting portion and the bonding arm, and wherein said terminal connecting part is provided on a surface opposite to a surface facing to a mounting substrate of the first core portion.

* * * * *